US006550321B1

(12) United States Patent
Patey et al.

(10) Patent No.: US 6,550,321 B1
(45) Date of Patent: Apr. 22, 2003

(54) APPARATUS FOR MEASURING AND RECORDING DATA FROM BOREHOLES

(75) Inventors: Ronald Ernest Russell Patey, Georgetown (CA); Kevin Allan Dooley, Brampton (CA); Douglas James Belshaw, Georgetown (CA)

(73) Assignee: Solinst Canada Limited, Georgetown (CA)

( * ) Notice: Subject to any disclaimer, the term of this patent is extended or adjusted under 35 U.S.C. 154(b) by 79 days.

(21) Appl. No.: 09/679,598

(22) Filed: Oct. 5, 2000

Related U.S. Application Data

(63) Continuation-in-part of application No. 09/158,357, filed on Sep. 18, 1998, now Pat. No. 6,158,276.

(30) Foreign Application Priority Data

Sep. 18, 1997 (GB) ..... 9719835

(51) Int. Cl.[7] ..... E21B 47/00; E21B 47/04; E21B 47/06

(52) U.S. Cl. ..... 73/152.18; 73/152.46; 73/152.52; 73/152.54

(58) Field of Search ..... 73/152.18, 152.19, 73/152.22, 152.23, 152.27, 152.28, 152.46, 152.51, 152.52, 152.54

(56) References Cited

U.S. PATENT DOCUMENTS

| | | | | | |
|---|---|---|---|---|---|
| 3,921,152 | A | | 11/1975 | Hagar et al. | |
| 4,388,690 | A | | 6/1983 | Lumsden | |
| 4,535,843 | A | * | 8/1985 | Jageler | 73/152.28 |
| 4,553,428 | A | * | 11/1985 | Upchurch | 73/152.51 |
| 4,624,136 | A | * | 11/1986 | Delatorre et al. | 73/152.54 |
| 4,733,224 | A | | 3/1988 | Kimura | |
| 4,736,367 | A | | 4/1988 | Wroblewski et al. | |
| 4,741,208 | A | * | 5/1988 | Vandevier | 73/152.51 |
| 4,831,558 | A | | 5/1989 | Shoup et al. | |
| 5,767,400 | A | * | 6/1998 | Nakano et al. | 73/152.46 |
| 5,831,156 | A | * | 11/1998 | Mullins | 73/152.18 |

OTHER PUBLICATIONS

Intelligent Data Acquisition or IDA, pp. 1–8, 1997.

* cited by examiner

*Primary Examiner*—Daniel S. Larkin
(74) *Attorney, Agent, or Firm*—Anthony Asquith & Co.

(57) ABSTRACT

For collecting data from a water well, down-hole sensors are housed in modules. The modules are arranged to be screwed together in-line to form a vertical string. Mechanically, the modules are secured to each other only by the screw connection. Data is transmitted to the surface on a 2-wire cable, there being no other electrical connection between the modules and the surface. The modules are connected in multi-drop configuration to the 2-wire cable. Data is transmitted using time-division multiplexing.

24 Claims, 11 Drawing Sheets

WIRE BYPASSING SENSOR IN MIDDLE OF TUBE

APPARATUS FOR MEASURING AND RECORDING DATA FROM BOREHOLES

This is a Continuation-in-Part of patent application Ser. No. 09/158/357, filed Sep. 18, 1998, now U.S. Pat. No. 6,158,276, granted.

This invention relates to instruments for taking measurements from wells and boreholes, being measurements of such parameters as water level, water pressure, temperature, and the like. The invention relates particularly to a system for configuring the various sensors, and for co-ordinating and presenting the data emanating therefrom.

BACKGROUND TO THE INVENTION

The task of gathering data from water wells and boreholes, and from bodies of water generally, has been the subject of much attention. However, the instruments and associated apparatus available hitherto have been somewhat inconvenient, especially from the standpoint of versatility and operational flexibility, and as to the presentation of the data obtained from the boreholes. The invention provides a modular system, which is aimed at easing some of these shortcomings.

Generally, the data from sensors, probes, and other instruments in water wells and boreholes is intended to be fed into a computer for final storage and presentation. The data may be transferred from the field equipment (i.e the equipment located actually at the well) to the computer by wire, by radio channel, via an infra-red data-communication port of the computer, or as appropriate. Instructions for operating the data gathering equipment can be communicated in the same way.

GENERAL FEATURES OF THE INVENTION

The invention has a two-wire cable going from the surface unit to the down-hole unit. This cable physically supports the down hole string of modules, the cable being capable of supporting not only its own weight and the weight of the string of modules, but also of enabling the cable to be tugged and pulled from the surface if the string should become snagged in the borehole.

The cable includes just two electrical conductors on the cable, and between the modules. One conductor is passed from module to module via the insulated central electrodes, and the other is passed via the module casings.

One of the main bases for the design of the present apparatus is to avoid the need for batteries on board the modules.

The modules include microprocessors, for conditioning and transmitting the data from the sensor to the surface. The microprocessor is mounted on a circuit board in the module, to which electrical leads connect the electrodes and the casing, and the sensor.

The sensors are for sensing down-borehole parameters, such as temperature, pressure, salinity, pH, oxygen-content, and so on.

The data from the different modules is multiplex-transmitted via the two-wire cable. The multiplexing system may be of the random-access type, with each module being uniquely addressable, or of the time-division type, with the modules being addressable only sequentially.

The system as described is aimed at ensuring that a data-gathering from all the modules takes place in a minimum time. This is important for keeping overall energy-draw from the battery to a minimum.

DETAILED DESCRIPTION OF PREFERRED EMBODIMENTS

By way of further explanation of the invention, exemplary embodiments of the invention will now be described with reference to the accompanying drawings, in which.

The apparatuses shown in the accompanying drawings and described below are examples which embody the invention. It should be noted that the scope of the invention is defined by the accompanying claims, and not necessarily by specific features of exemplary embodiments.

Figure 1:
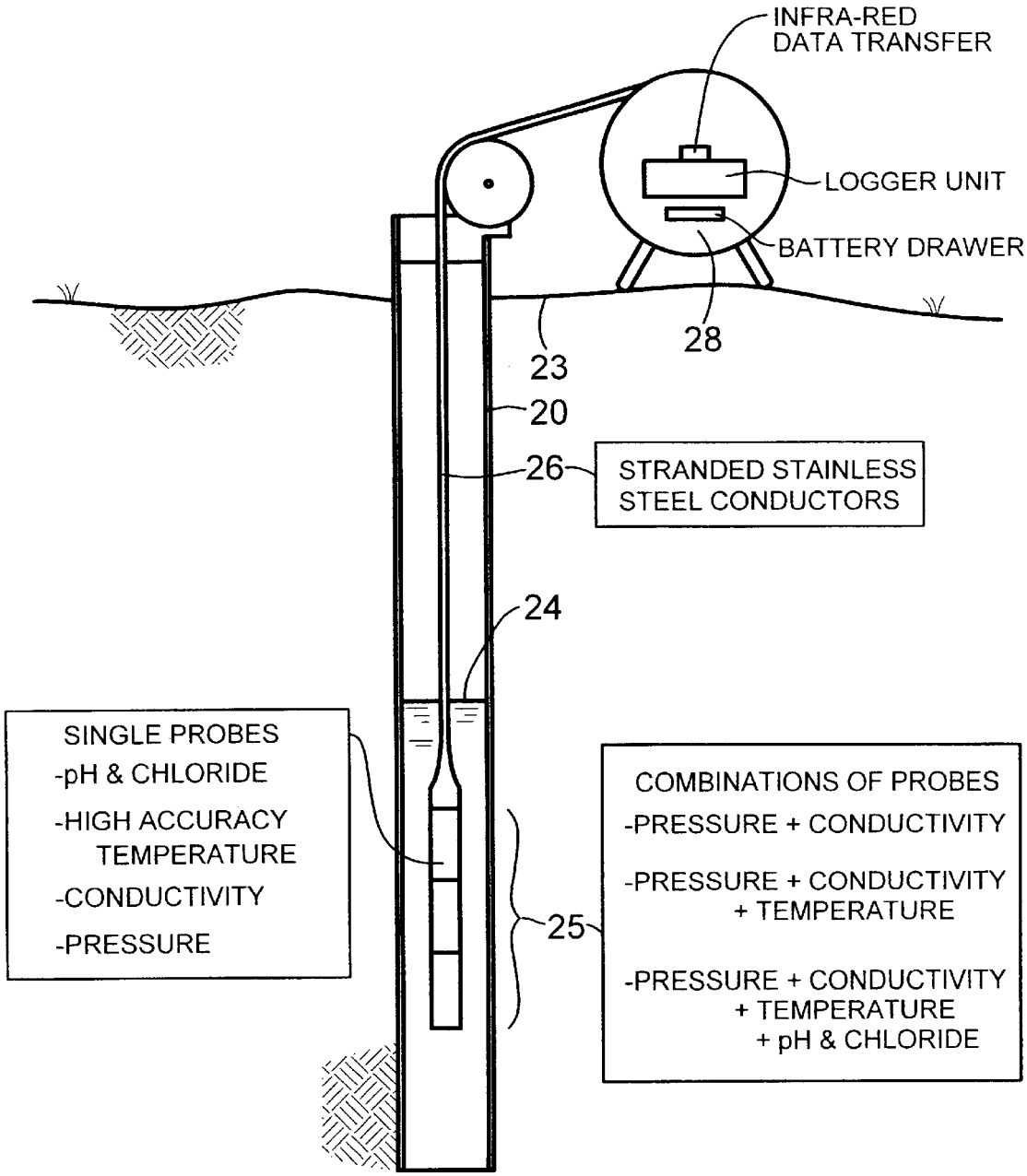
FIG. 1 is a diagrammatic side elevation of a borehole or well, in which is located data measuring and collecting apparatus, which includes a string of modules connected to a surface control-unit.

FIG. 1 shows a borehole 20 in the ground 23. Water is present in the borehole, to a level 24. A string 25 of sensor modules is suspended in the well from the surface, by means of a two-wire tape 26. At the surface, the tape is wound onto a reel. The surface unit 28 receives the upper ends of the two wires in the two-wire cable, and includes data-processing and recording facilities, also programming facilities, and facilities for transmitting data. The string 25 of sensor modules can be raised and lowered to different depths in the well 20, and can be taken right out of the well. Thus, the sensors and reel unit can be transferred to a different well.

Figure 2:
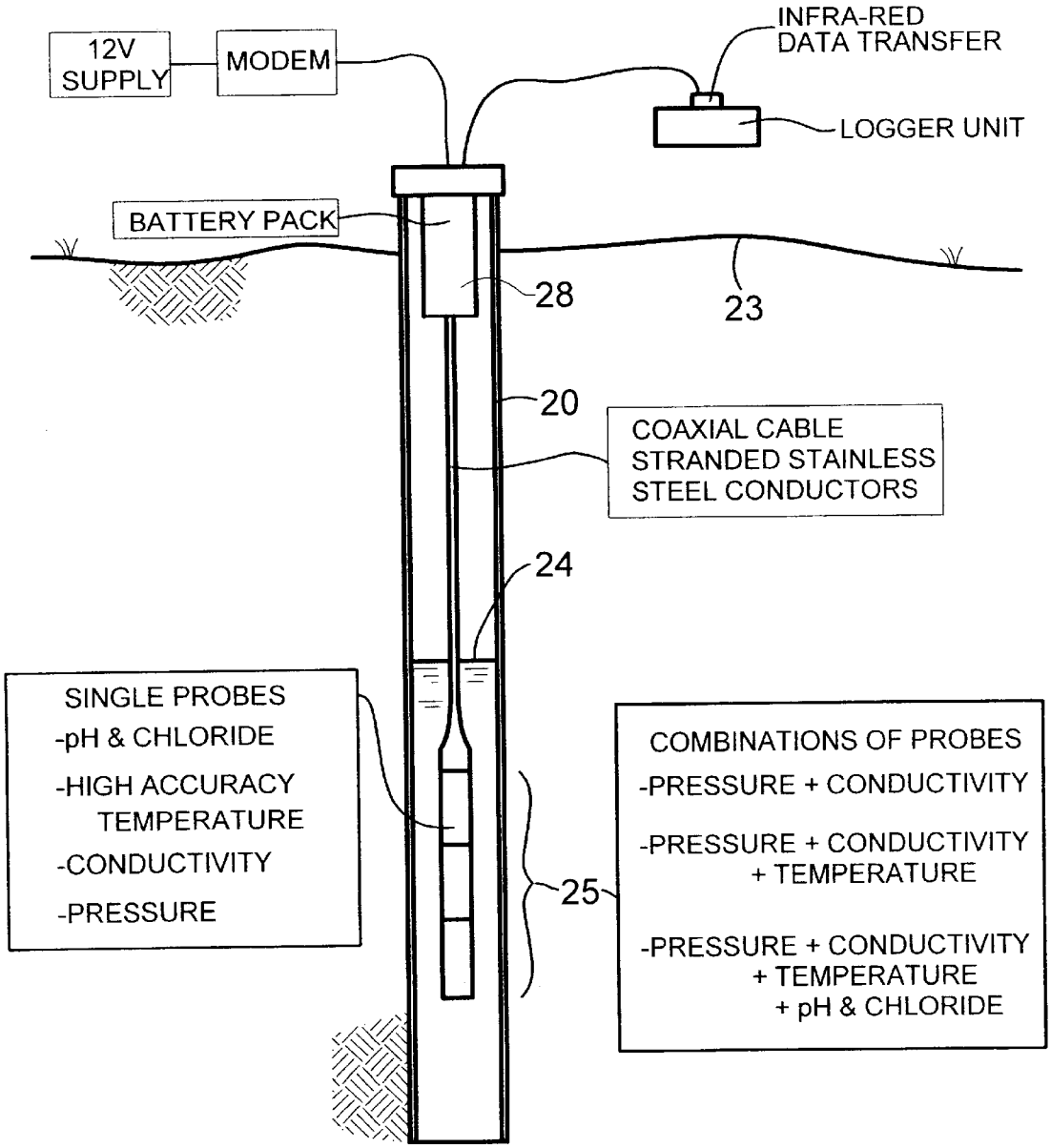
FIG. 2 is a similar view to that of FIG. 1, showing a string of modules connected to a different kind of surface control-unit.

In FIG. 2, the modules are dedicated to taking readings always from the same well, and in fact always from the same level in that well. Now, the surface unit 28 does not need to include a winding reel.

In FIG. 1, the two-wire tape is flat, and suitable for winding onto a reel. In FIG. 2, the two-wire cable is round, and the wires may be arranged side-by side, or in co-axial configuration.

In either case, strings of modules can be suspended from the two-wire suspension tape. Sensors can be provided in the modules to measure, as shown: pressure; conductivity; (high accuracy) temperature; pH and chloride; and also: water level; salinity; redox voltage; dissolved oxygen; turbidity; and more.

Figure 3:
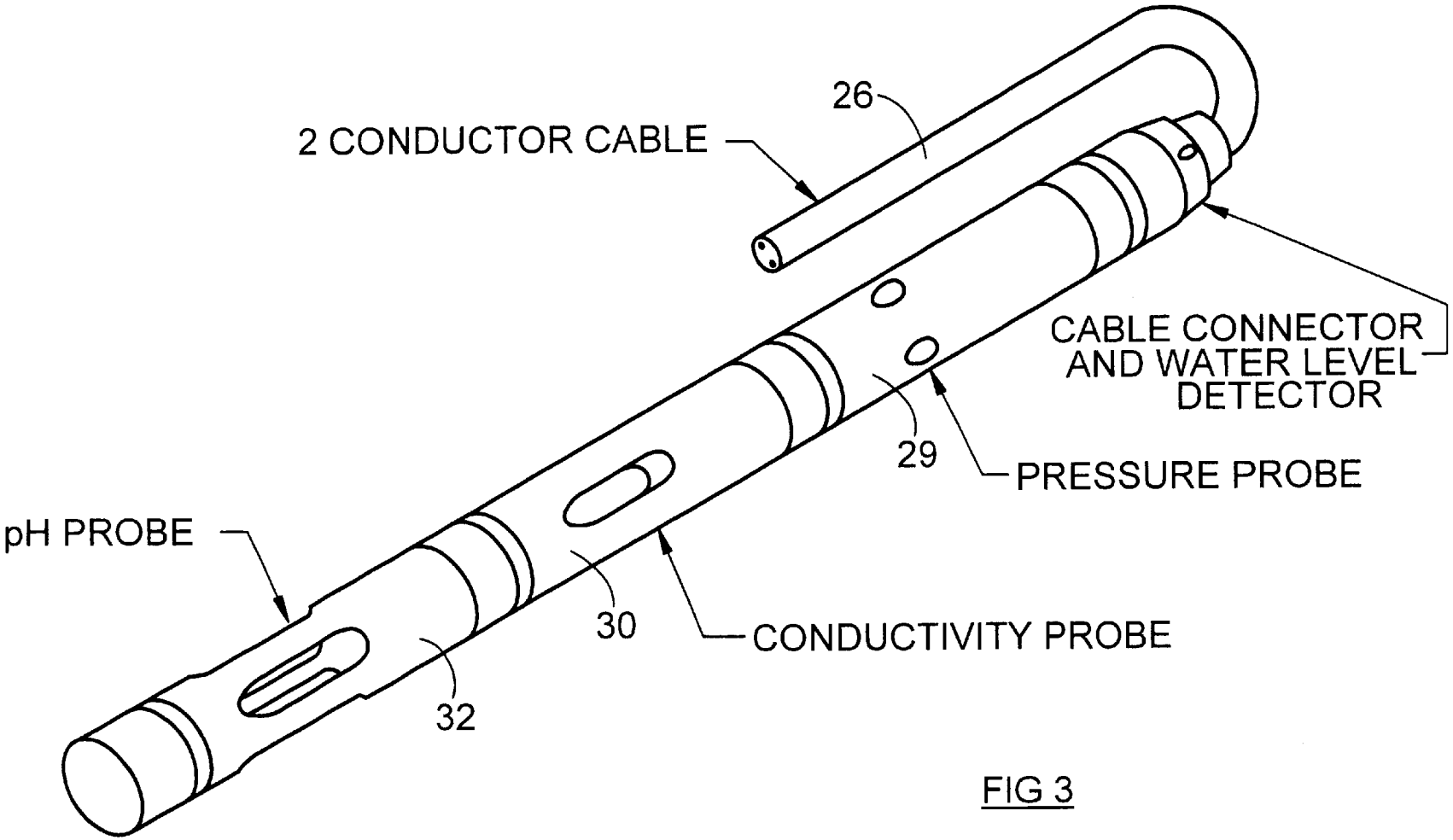
FIG. 3 is a pictorial view of a string of modules.

FIG. 3 is a close-up of a typical string 25 of modules, attached to the bottom of a two-wire tape 26. In this case, the modules include a pressure sensor 29, a conductivity sensor 30, and a pH sensor 32.

Figure 4:
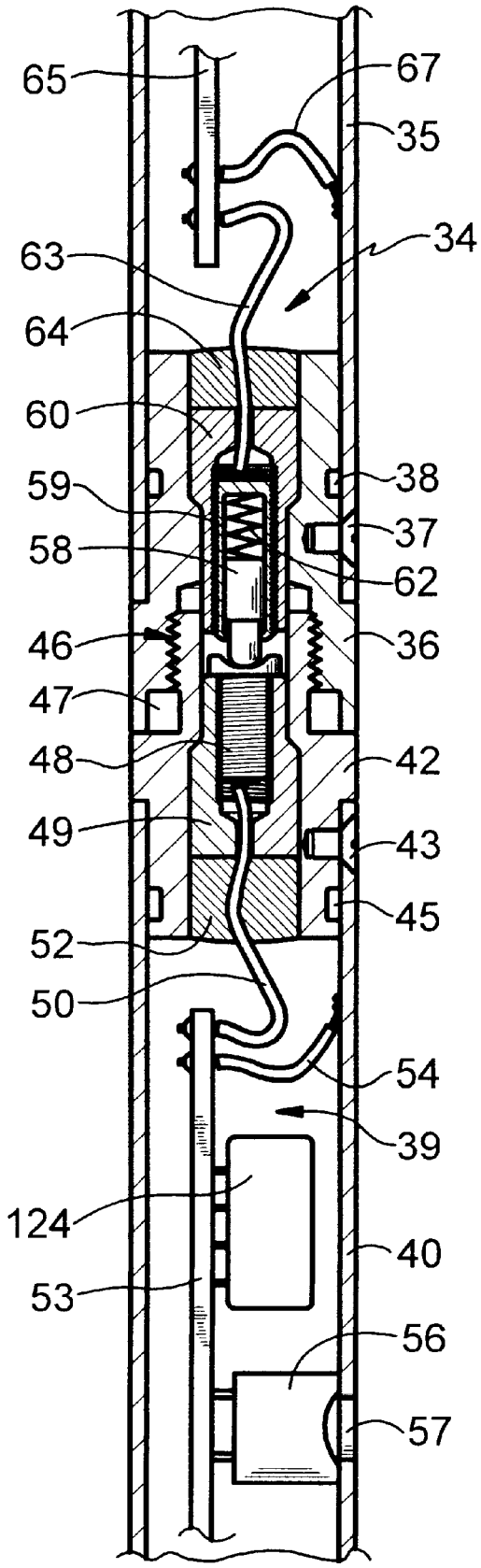
FIG. 4 is a cross-section of two modules, showing the manner of connection therebetween.

In FIG. 4, the upper module 34 includes a tubular outer casing 35, of stainless steel. A bottom plug 36 fits the casing, and the plug is mechanically fixed to the casing by means of radial screws 37, which in this case are three in number, pitched around the circumference of the casing. The screws 37 secure the casing 35 to the plug 36, against forces tending to pull the plug out axially, and against forces tending to twist the plug relative to the casing. The plug 36 is sealed to the casing 35 by means of O-ring 38.

The lower module 39 includes a similar tubular casing 40, also of stainless steel. A top plug 42 fits the casing, and is secured and sealed to the casing through the three screws 43 and the O-ring 45.

The plugs 36,42 are made of stainless steel, and are mechanically connected together by a screw-thread connection 46. O-ring 47 forms a seal when the plugs are screwed together.

The top plug 42 of the lower module 39 is fitted with a stainless steel button 48, mounted in a sleeve 49 of insulating Teflon (trademark). The button 48 is threaded into the Teflon. Connecting wire 50 is soldered to the bottom end of the button 49. The Teflon sleeve and the connecting wire are fixed in place within the top plug 42 by being potted into the plug with epoxy 52.

The connecting wire 50 is soldered to a circuit board 53 of the lower module 39. The circuit board 53 also receives a wire 54, which connects the stainless steel casing 40 to a suitable point on the board 53. Thus, the board 53 in the lower module 39 is coupled electrically to the upper module 34 via the connecting wire 50 from the button 48, and via the connecting wire 54 from the casing 40.

The module 39 includes a sensor 56, which is exposed to the water outside the casing 40, through a window 57, for the purpose of sensing the particular parameter as measured by the sensor.

As shown in FIG. 4, the bottom plug 36 in the upper module 34 includes a plunger 58, which is carried in a stainless steel shank 59, which in turn is carried inside a sleeve 60 of insulating Teflon. The plunger 58 is loose enough to slide axially within the shank 59, under the control of a spring 62. The plunger 58 makes electrical contact with the shank 59, to which a connecting wire 63 is soldered. The Teflon sleeve is held in place in the plug 36 by potting epoxy 64. The connecting wire 63 passes through the epoxy, and is connected to the circuit board 65. Again, a lead 67 from the casing 35 of the upper module also connects the casing to the circuit board.

It will be appreciated that the upper module 34 can be assembled to, and disassembled from, the lower module 39 in a mechanically very robust manner. The only action required of a person, in making the coupling between the two modules, is simply to screw the modules together.

As a general rule, whenever a task of assembly of a piece of equipment is left to the user, the danger arises that some people will use too little force, while others will use far too much. In the present case, a system of mechanical securement by a screw thread is simple and robust enough that it can hardly be abused. While of course the prudent user will take care to screw the components tightly together, with the design as shown, the components could even be somewhat slack and still the mechanical connection would be secure, and still the outside water and liquids would be kept sealed out, and still the electrical connections between the modules would be made. There are no forces tending to unscrew the assembly of modules during use, nor when lowering the modules into, nor when pulling them out, of the borehole.

The screw-thread connection 46 is tightened by grasping the modules in the hands, and twisting them together. The screw threads are formed actually in the plugs 36,42, whereas of course it is the casings 35,40 that the person will actually grasp in his hands, when carrying out the task of screwing the modules together. Some persons can be rather heavy-handed on such occasions, but the design as illustrated ensures that the casings are connected (using the three-screw format) to the respective plugs in a highly secure manner that easily stands up to any forces that can be applied by the hands of a person.

It should be noted that the O-ring 47 has to be compressed when screwing the modules together, which can take a considerable force, but again the force is well within the capabilities of a normal person. The outside surfaces of the casings, and of the plugs, can be knurled or otherwise roughened, if desired, to improve the hand grip.

Again, the simplicity of the manner of connection is emphasized: the modules are connected simply by grasping the modules in the hands, and screwing them together. That single, simple action makes the mechanical connection, the electrical connection, and the seal.

As described, the set of modules is suspended on conventional two-wire tape or cable. Such tape is available as a standard item, the tape comprising a pair of stainless steel wires, held in a spaced apart relationship by an enveloping plastic cover. The distance apart of the wires is 8 mm in a typical case. The wires provide the mechanical strength of the tape, for supporting the weight of the modules—in addition, of course, to providing the electrical functions. The plastic cover of the tape is marked with depth markings, which can be read off at the surface to indicate the depth of the probe in the borehole.

Figure 6:
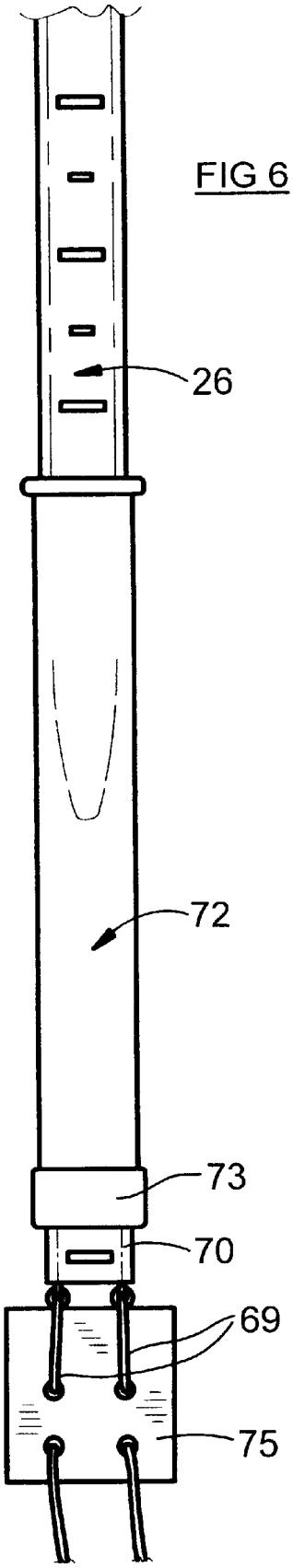
FIG. 6 is a front view corresponding to FIG. 5.
Figure 5:
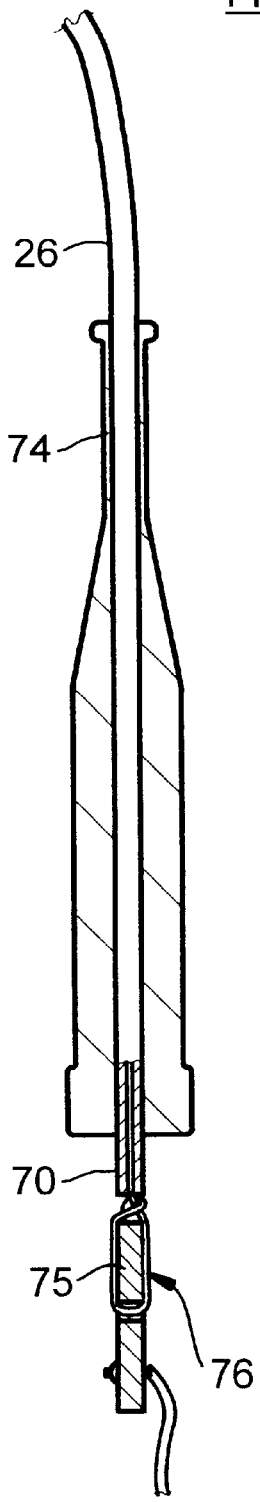
FIG. 5 is a side-view of the bottom end of a cable of the apparatus, and some components associated therewith.
Figure 7:
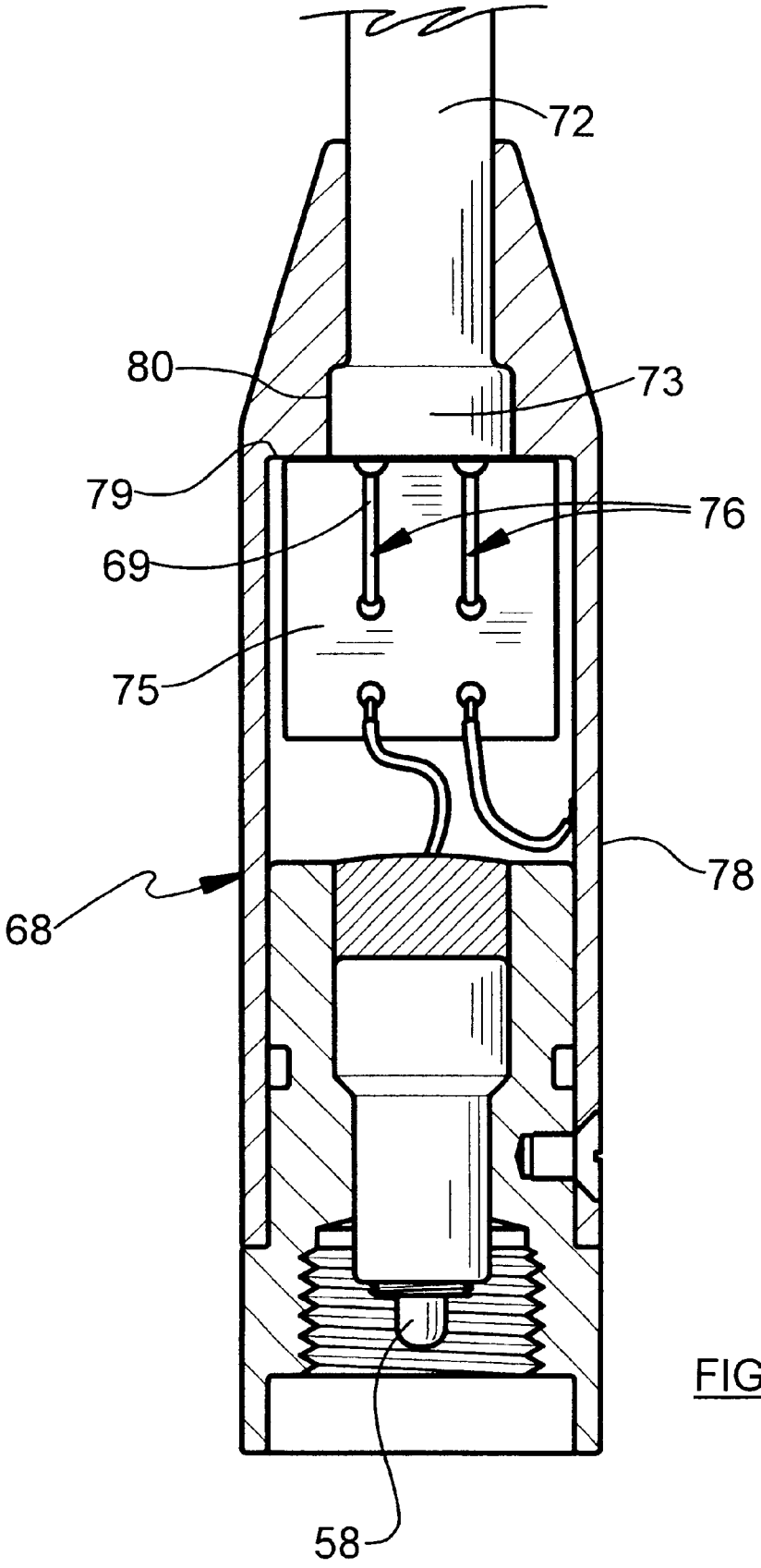
FIG. 7 is a cross-section showing the components of FIGS. 5, 6 incorporated into a module.

FIGS. 5, 6, 7 show how the tape is coupled to the topmost module 68, in a manner that leaves the topmost module suitable for the connection of the sensor-modules underneath.

FIG. 5 is a side-view, and FIG. 6 is a front view. These views show a tape 26, having two wires 69 and a plastic cover 70. A conventional rubber boot 72 encases the lower end of the tape 26. The rubber boot includes a flange 73 at the bottom end, and a tail 74 at the top end. The inside of the rubber boot 72 is a tight fit over the plastic cover of the tape, and, when the unit is under water in a borehole, the boot is pressed against the plastic cover of the tape by hydraulic pressure, and thereby forms an effective seal around the tape.

The two stainless steel wires 69 emerge from below the bottom end of the plastic cover 70. The wires are fed through suitable holes in a small piece 75 of circuit board, and the wires are then looped back and over each other, as shown. The loops 76 through the circuit board 75 are made permanent by soldering the wires into that configuration.

As shown in FIG. 7, the topmost module 68 has a housing 78, and vertical forces acting on and via the tape are fed into the housing 78 by means of an abutment between the circuit board 75 and a shoulder 79 formed in the housing 78. As to the strength of this manner of making the joint, it is noted that two-wire stainless-steel tape of the type likely to be considered in the present application has a breaking strength in the region of 100 kg; looping the wires through a piece of circuit board, as described, and abutting the circuit board against the shoulder in the housing, has been found to provide a manner of securing the tape to the housing that is stronger than the tape itself.

The flange 73 of the rubber boot enters a counterbore 80 in the housing 78 when the cable pulls the board 75 tight against the shoulder 79. The fit of the components is such that the rubber is thereby compressed, whereby an effective seal is formed, which ensures the circuit board remains sealed from liquid in the borehole, during use. The open cavity inside the housing is filled with potting compound, which of course is also effective to seal both the board and the mechanical and electrical connections thereto.

It should be noted that all the open cavities inside all the modules are filled with potting compound. As such, the modules (probably) cannot be repaired, but the gain in robustness due to complete potting is worthwhile in this case. The modules as described are extremely strong and robust, and amply able to stand up to long periods of field service. The manner of joining the modules together is in keeping with the generally extremely robust nature of the modules themselves. Of course, nothing can be completely unbreakable and foolproof; however, in the context of conventional borehole instrumentation, those terms are not inappropriate to describe the designs as depicted herein. If anything is a weak link, it is the two-wire tape, in the sense that the tape will break before the modules will break, on a straight tensile pull basis. It might be considered that there is no point making the modules stronger than the tape. However, the modules have to stand up to being handled, and screwed together, and the extra strength of the modules as compared with the tape, and the extra robustness arising from the manner of joining the modules together, is worthwhile because of these extra arduous duties that fall to the modules and not to the tape. The housing 78 of the topmost module 68 is subject to being grasped and screwed, and must be robust and strong enough to stand up to that; if a person were to grasp the tape, as a way of screwing the topmost module to the next module below, that action might well cause damage to the tape. The designer should see to it that the housing 78 of the topmost module is long enough to make sure the person can apply plenty of grip thereto, without touching the tape.

The electrical connections from the two wires 69 are fed from the board 75, one to the central plunger 58 of the bottom plug 36 of the topmost module, and the other to the housing 78 of the topmost module. The central plunger 58 is spring-loaded, in the manner as previously described, and contained within the insulative Teflon sleeve 60. The board 75 can be bolted into the housing 78, instead of (or in addition to) abutting the shoulder 79, for extra security, if desired.

It will be understood that the topmost module as described includes no sensors, electronics, or instrumentation, but rather the topmost module just receives the two wires, and passes them through to the next module below. Alternatively, the topmost module can incorporate an instrument or sensor. For example, the topmost module can incorporate a water level detector, as shown in FIG. 8.

Figure 8:
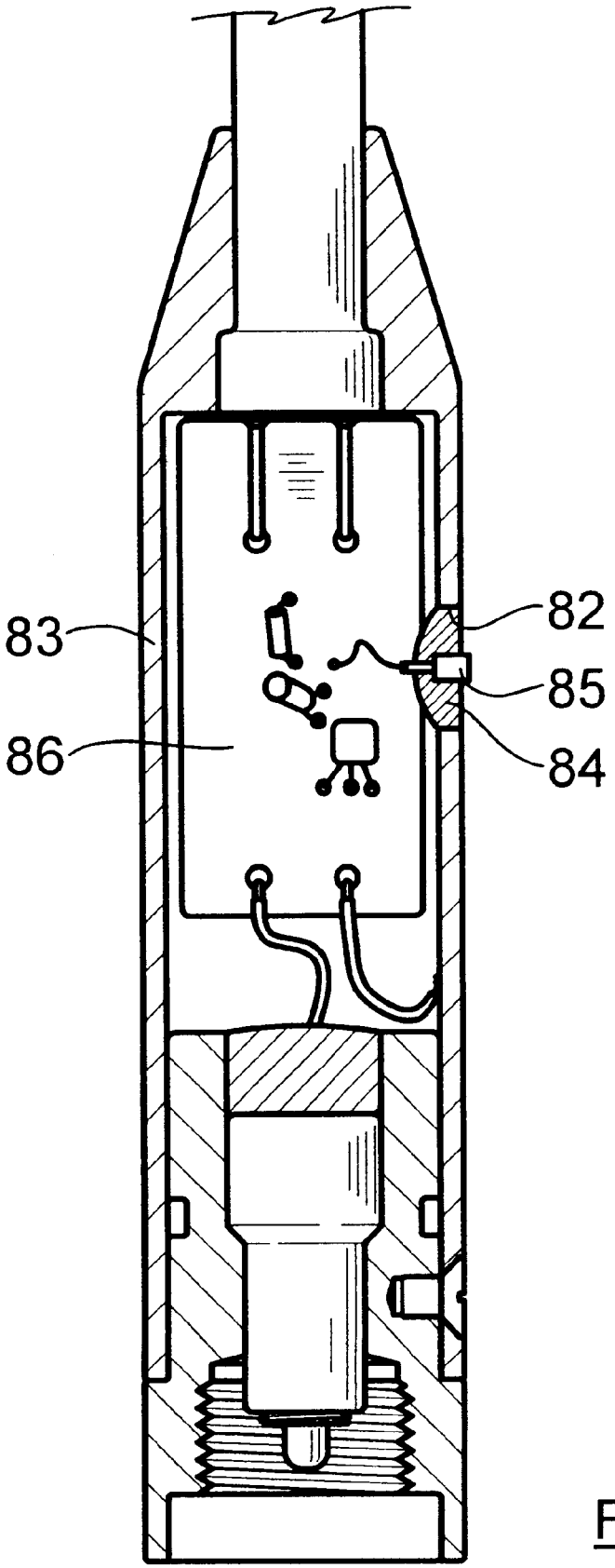
FIG. 8 is a cross-section like FIG. 7 of a different module.

In FIG. 8, an aperture 82 is cut in the wall of the housing 83, and a piece 84 of nylon is inserted in the aperture. The nylon 84 carries an electrode 85, which is exposed to water present outside the housing. The housing of course is also exposed to such water. The empty spaces inside the housing, again, are potted with epoxy. If water is present, the water shorts the electrode 85 to the housing 83, and that fact is detected by a circuit, the components of which are carried on the circuit board 86. The measurement can be signalled via to the two wires in the tape 26, to the surface. (The zero point of the scale marked on the tape should coincide with the level of the electrode 85.)

Of course, if the water level detector is built into the topmost module, some flexibility or versatility is lost, in the sense that the water level detector cannot be placed elsewhere, and no other module can be located as the topmost module. However, the loss of flexibility is not important because, although not every application requires a water level detector, most applications do. In the present case, the assembly of in-line modules is lowered into a water well, or other borehole, having a diameter that is not much greater than the diameter of the modules. If the string of modules includes many of the modules, the aggregate assembly has quite a large volume, and it would be expected that the water level in the borehole would rise temporarily as the module assembly is lowered into the water. Therefore, the initial reading of water level will be too high. Generally, it is required to detect the water level after the level settles down, i.e after having accommodated the large volume of the module string submerged below the water level. Having the water level indicator in the topmost module allows this to be done.

The modules can, generally, be screwed together in any order. The sensors are generally independent of where their module is located in the string of modules. If a particular type of sensor just cannot be incorporated into a module on a screw-thread-at-each-end basis, but has to be open and accessible at one end, that type of sensor can be accommodated, by being placed always in the bottommost module. Of course, there can only be one bottommost module. However, it is recognised that virtually every type of sensor that is likely to be considered for lowering into a borehole can be accommodated in a screw-thread-at-each-end module.

Figure 10:
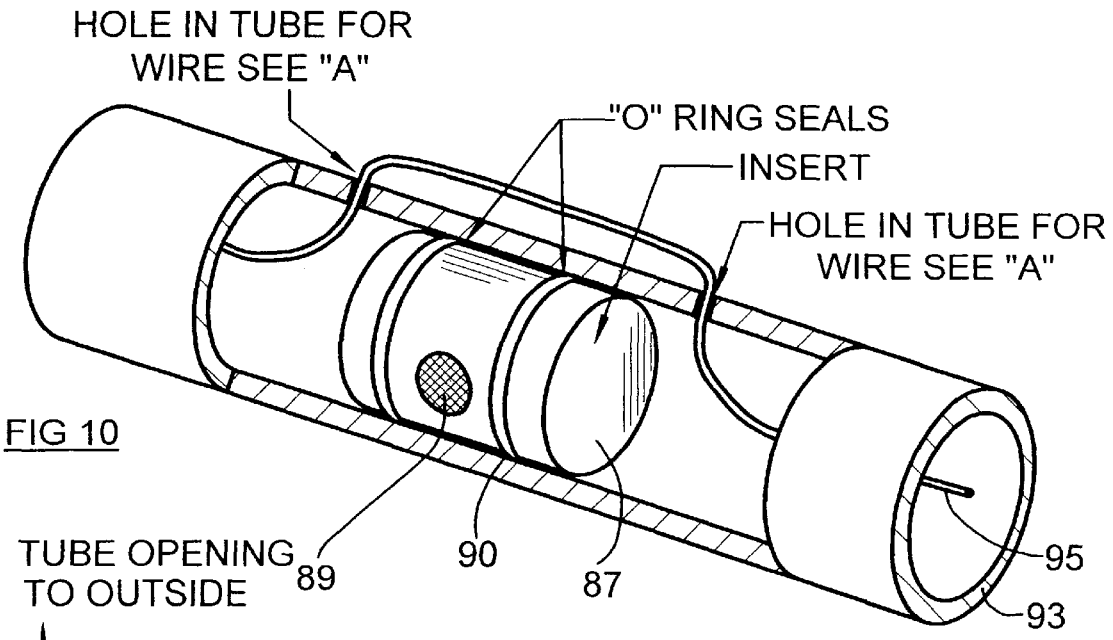
FIG. 10 is a diagram of the set up of FIG. 9.
Figure 9:
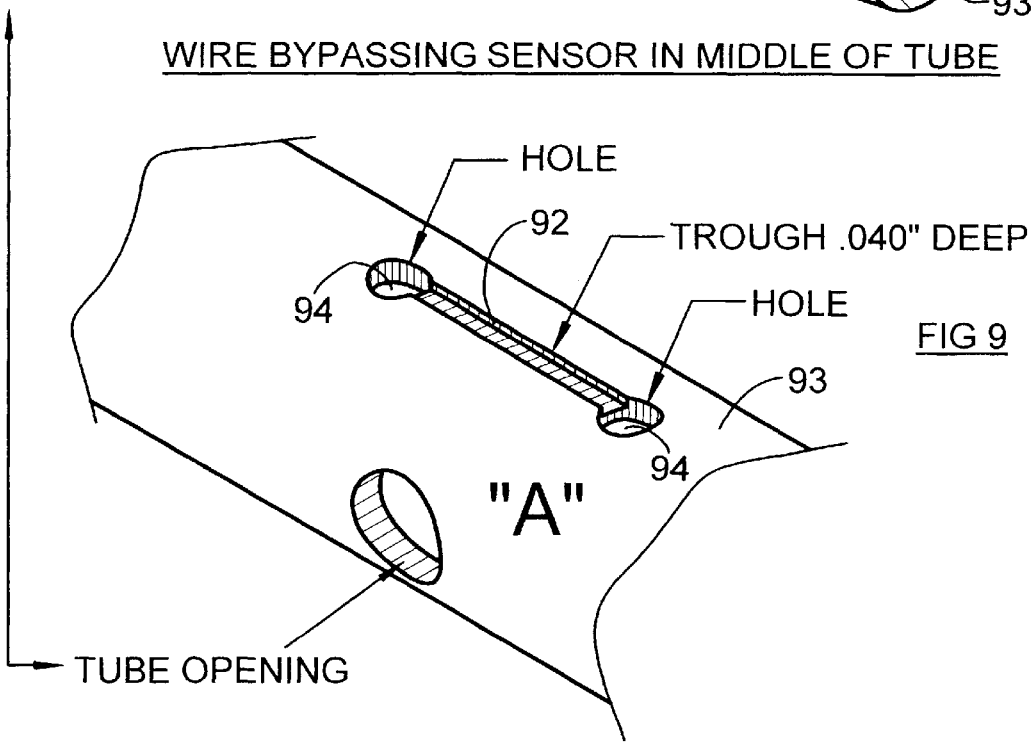
FIG. 9 is a pictorial view of a portion of a wall of a module, having a means for by-passing a through-wire around a sensor contained in the module.
Figure 11:
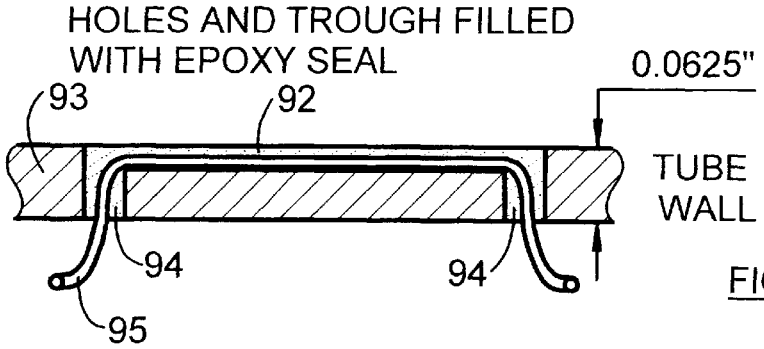
FIG. 11 is cross-section of the portion of the wall shown in FIG. 9.
Figure 12:
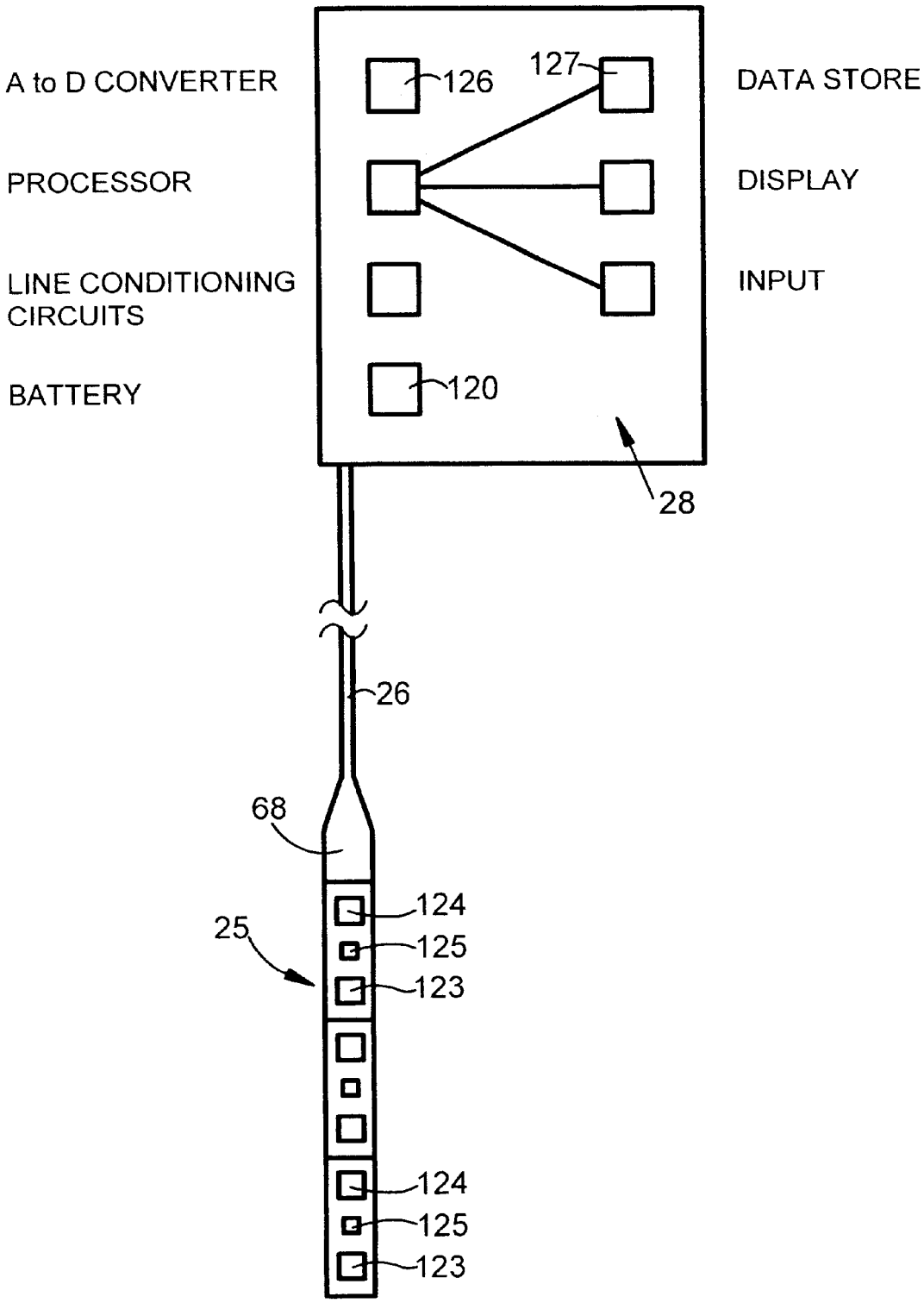
FIG. 12 is a diagram showing interaction between the down-hole and surface components of the apparatus.
Figure 13:
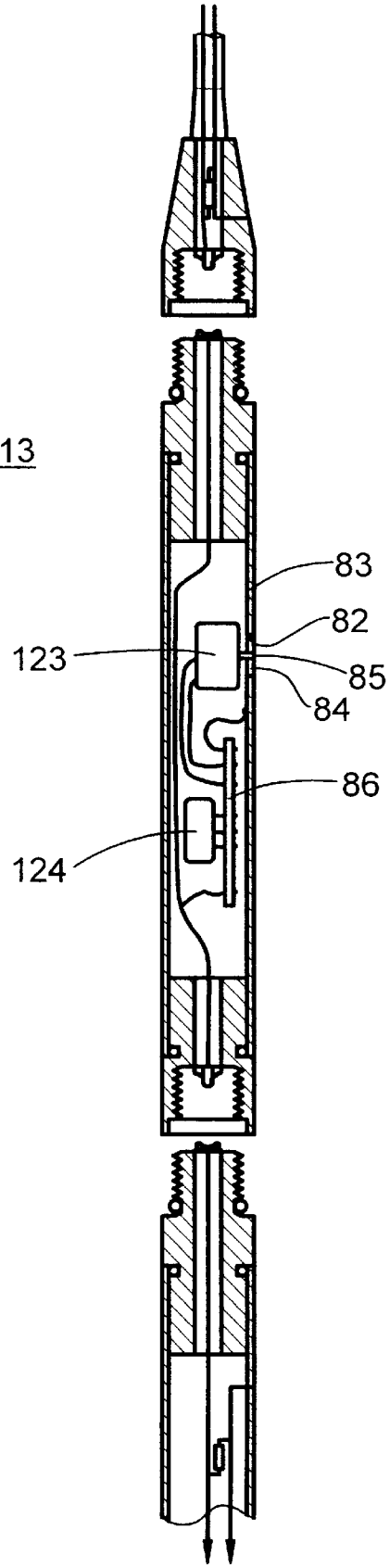
FIG. 13 is a diagram showing the disposition of a through-wire in one of the modules.

Each type of sensor needs to be exposed to the water or other liquid in the borehole, and in nearly every case this means that a window has to be provided in the wall of the module, through which water can reach the sensor. FIGS. 9, 10, 11 show how a pressure sensor of conventional type can be accommodated into the module. The sensor unit 87 has a segment 89, which is exposed to the water pressure. The sensor includes O-ring seals 90 above and below the segment. A window is cut in the casing of the module, to allow water to enter, and to make contact with the segment 89. The sensor unit 87 is a proprietary item, and it would be inappropriate to drill a hole therethrough, to enable a wire to be passed axially right through the sensor unit. Instead, a channel 92 is milled partway through the wall of the module casing 93. Holes 94 are provided at the ends of the channel 92, and the through-wire 95 can be passed through the holes, and accommodated in the channel, in the manner as shown. As a final stage of its manufacture, the module will be potted in any event, and it is simply arranged that the potting epoxy fills the channel 92 and holes 94. The through-wire 95 connects the plunger and button at the respective ends of the module, and is insulated from the casing 93. Of course, a lead is taken from the through-wire 95 for connection to the circuit board provided as a component of the conductivity sensor module, and another lead connects the board to the casing 93.

The design as described provides modules that are generally solid, hard, unitary, and substantially completely self-contained. The modules are self-contained as to their electrical functioning, and as to their manner of mechanical mounting. There is nothing protruding from the module, and nothing fragile about the module. There is nothing for the operator to do to connect the modules together other than to hold them in the hands and screw them together. The operator does not have to line anything up, or make any fiddly connections. In the preferred form, there are no batteries inside the module, so the module does not even have to be dismantled to change the batteries. The modules are maintenance-free (actually, no maintenance is possible). The modules are so robust, in fact, that a user might think the module can be dropped, or otherwise treated roughly, with impunity; but, although the module itself would stand up to such abuse, the sophisticated sensors and instrumentation within the module might be damaged.

The modules being arranged in line one above the other, of course the sensors in the modules lie at different levels in the borehole. However, it may be stated that excess vertical length does not matter so much in a well. (If there is one dimension a borehole can readily accommodate, it is depth.) Putting the sensors side-by-side in a common housing (or in separate housings), rather than in-line as depicted herein, leads to the sensor unit being necessarily of a larger diameter.

It is recognised that the modules do not all need to be together at the same level. Indeed, having the modules separated vertically means that they each sample a slightly different volume of water. It is possible that some of the modules might interfere with each other (it can be surmised, for example, that the act of taking a specific ion measurement might affect a conductivity measurement, if both those sensors were close together). Vertical separation, arising from placing the modules in line vertically, ensures that that kind of interference cannot happen.

Another advantage that arises from arranging the modules as a vertical string is that two modules of the same type can act as a check on each other: for example, a calibration or malfunction check. One of the modules of the particular type would be redundant, but would provide verification in case the integrity of the other module of that type should be questioned. Also, the vertical string permits one module to be calibrated against another of the same type, on the same string.

The main benefit of arranging the modules in a vertical string, however, is that the string can be of small diameter, and can therefore fit down small-bore wells. Wells having a nominal bore of one inch (25.4 mm) are common, and previous designs of instrument packages for such wells, especially deep wells, have been expensive, fragile, or otherwise generally unsatisfactory. The modules as described herein are 0.9 inch diameter, and therefore highly suitable for placement into a one-inch well. It will be appreciated that although the modules herein are thin, structural robustness has not been compromised. Also, the sensors are housed basically one per module, and are not compromised by having to be crammed or squeezed into a radially-tiny and/or axially-tiny space. (It is not a limitation of the invention that the modules only contain one sensor each.)

The designs as described herein show how it is possible for the module string to be designed to have its components large and chunky, and yet to fit down a 1-inch borehole. It will be noted that the designs do not give rise to protruding or snaggable edges or corners. The sensors themselves do not have to be particularly small, nor does the associated electronic circuitry, nor do the mechanical components, and these things can be engineered for robustness and performance, without compromise.

It is contemplated that more than one string of modules might be included on the same two-wire tape. Thus, a string of four modules might be placed at a depth of 100 metres, and then a string of five more modules might be placed at 200 metres depth. A connector would be needed in that case for joining the bottom of the upper string to a further length of two-wire tape. The connector for joining this further piece of tape to the second string, underneath, then would be a repeat of the structure shown in FIG. 7.

It is noted that the present modules are highly suitable for field usage. For field usage, the modules need to be designed to stand up to a certain degree of abuse. Everything fragile about the modules is inside a thick, solid casing. The electrical contacts 48,58 are well shrouded and protected. Possibly, the male thread and the O-ring 47 might be said to be exposed, and therefore vulnerable; however, the male thread is chunky and robust, and would be difficult to damage.

The modularity of the system provides interchangeability. Interchangeability of the modules means that different ones of the modules can be connected together, for various purposes, as for example: (a) Several of the same type of module can be fitted into the string. The modules can then each calibrate the other, in the sense of confirming that all the calibrations are the same. (b) With pressure transducers, accuracy and sensitivity are features that go with only a small range of pressure. So, the need arises to change transducers as the depth changes, or to change to a small-range high-accuracy transducer from a large-range general purpose transducer. (c) Some types of sensor use reference cells, which need to be checked regularly (e.g pH sensor, dissolved oxygen sensor), whereby those modules need to be removed and re-attached.

The design of the modules is such that the top electrode (button 48) and the bottom electrode (plunger 58) of the module are co-axial with the screw-threads 46 (and with the outer casing). Being formed in the plugs, the screw threads are solid with the outer casing. This arrangement lends itself to a mechanical connection, which, though very simple to operate, is very strong and robust; the arrangement also lends itself to automatically producing an electrical connection, which is made automatically upon the mechanical connection being made, and which is also very strong and robust. Because there is only one electrode to make contact, and that is co-axial with the screw thread, making the electrical connection is foolproof and effortless.

The single central co-axial electrode not only means that the making of the connection can be advantageous electrically, but also, such a connection lends itself to being accommodated in a unit of minimum cross-sectional profile.

The instruments and sensors themselves can be proprietary items. The designs described herein are concerned with the modular manner of packaging the sensors, and enabling the sensors to communicate their data measurements to the surface.

The electrical characteristics of the modular system will now be described.

The battery for powering the whole system is a 9 volt battery 120 located in the surface unit 28. There are no batteries in the modules. The power supply is fed to the modules via the two wires in the two-wire tape 26. Data is transmitted up-hole and down-hole also via the same two wires. There is no separate channel or bus for data, and there are no separate leads to convey power to the modules from the battery at the surface.

When gathering data from the modules, measurements are taken from the modules in sequence. The scan sequence is initiated by a signal from the surface control-unit 28. Upon initiation, the sensor 123 in the module carries out a measurement of its parameter, and then gets ready to transmit the data up-hole, via the two wires. The initiation of a scan may be by a manual input at the surface unit, or automatically on a pre-arranged schedule.

During a scan of the modules, the data transmitted from the modules has to be identified, as to which module is sending the data. Each module has the ability to transmit data relating to what type of sensor it is, its serial number, date of calibration, and so on. (The serial number of the module can be a component in a display of the data from the module, whereupon the user has visual confirmation that the serial number corresponds with that marked on the outside of the casing of the module.)

The very first time a down-hole module is coupled to a particular surface control-unit, an operation to match the module to the control-unit is performed, and a set-up code is assigned to the module confirming that match, and registering it in the control unit and in the module. But that operation only needs to be performed once: after that, the module can be included in the string, or not, without additional set up, i.e just by screwing the module into the string. The fact that a code has been assigned to the module means that data from that module will be recognised and accepted, whenever the module is included in the string of modules. It may be noted that this simplicity with which the modules can be added, from the electrical standpoint, is in keeping with the simplicity with which they can be added from the mechanical standpoint.

A user might wish to purchase a further module, to add to a stable of available modules. When introducing an additional module for the first time, the match has to be confirmed, and a confirmation code issued, but after that the new module can be added to the string simply by screwing it on. In some cases, when a new module is added, it is found convenient to re-start all the modules from scratch, i.e to re-introduce all the modules, as if they were all being connected for the first time.

In a system that comprises, say, six modules, the users often would not wish to include all six on every occasion. In the system as described herein, the users do not need to have to re-identify the particular modules selected each time. Rather, the modules need only be identified into the system once, and the code-numbers assigned, and thereafter the system detects which modules are transmitting data, from its register of matched, preidentified modules. Again, it may be noted that automatically recognising which modules are present, i.e automatically in response simply to the module being present on the string, is very much in keeping with the above-described ease and simplicity with which the modular system as described herein is physically assembled and made ready for use.

The users would also prefer to be free to assemble and re-assemble the string of modules in any order (unless there is a physical reason for ordering the modules in a certain way), without the order affecting the data gathering function. Also, the users would not wish to be required to remember or record which order the modules are in, down the borehole. The users would wish just to screw the modules together, in any order; then lower the string of modules down the borehole; and then proceed to gather data. Again, the system as described enables this preference. Provided the data is identified as to which sensor is the source of the data, generally it is of no concern to the users as to which sequence or order the sensors transmit their data, nor in which order the modules are located physically on the string. In the case of pressure transducers, however, it can be important to record where the pressure transducer lies in relation to the zero-point of the scale marked on the two-wire tape, since depth affects the pressure reading.

To initiate a round of data gathering, the surface control-unit 28 signals the modules. This can be done by shorting the two wires together for a suitable period. This signal indicates start-of-scan to the modules. Upon receipt of the start-of scan signal, each module on the string activates its sensor 123 to take a measurement or reading of its particular parameter, and gets ready to transmit the data up to the surface control-unit.

The modules being unpowered, the module cannot itself apply live voltage across the wires. The energy to operate the module's data transmission operations is derived, during the act of transmission, from the wires, i.e from voltage applied to the wires from above. (The energy to power the microprocessors 124 in the modules, however, is derived from respective charged capacitors 125 in the modules, as will be explained.)

For data transmission up-hole, upon receiving instructions to put its packet of data onto the two wires, an individual module transmits bits by serially shorting the wires. Thus, the surface control-unit, in order to detect the data bits, needs the capability to detect the difference between short circuit and open circuit, i.e between high resistance and low resistance on the wires. Given that there can be a considerable line resistance in the two wires (stainless steel being not a particularly good electrical conductor, and the wires being perhaps 1000 metres long) the surface unit has to be sensitive enough to detect the difference between open circuit (i.e many megohm) and, say, 30 kilohm. That is to say, the difference between a 1-bit and a 0-bit, as transmitted by the modules, from down the borehole, is measurable at the surface as the difference between 30 kΩ and 100 MΩ.

The required sensitivity at the surface control-unit 28 for detecting this difference, at modulation speeds, is provided by an analog-to-digital converter 126. In the surface control-unit, a suitable voltage drop is applied across the wires when reading data from below, and the analog-to-digital converter in the surface control-unit picks up the peaks and valleys of the voltage changes across a reference resistor (of e.g 100 Ω), i.e the peaks and valleys caused by the bit-modulated fluctuations in resistance, below.

Although the modules are basically not powered, as described, it is contemplated that there are some types of sensor that will not be able to operate satisfactorily from the power as supplied from the surface via the two wires, and that consequently a battery might in fact be needed, on board the module. That is to say, a battery might be needed for the purpose of operating the sensor to take its measurements. In that case, given that a battery has then to be provided on board the module in any event, to power the sensor measurement operations, it might then be convenient and appropriate to use the battery to apply live voltage to the wires when transmitting the data bits up from that module. During the initial introduction and matching of the powered module to the surface controlunit, the control-unit can be instructed to expect live voltage on the wires, from that module when it transmits data.

When a battery is present in the system, other than the battery in the surface control-unit, a means should be provided for disconnecting that other battery when there is communication on the cable.

However, it is stressed that the system as described herein is suitable for use with unpowered modules (or specifically, for unpowered data transmission from modules), and is intended for use mainly with such modules. The designer would surely select a different type of data transmission system, in a case where battery power was always available on every sensor, down the borehole, for data transmission purposes.

After the start-of-scan signal has been issued, and the modules are all ready to take measurements and transmit data up-hole, multiplexing is used to sequence the data transmissions and other actions from the several modules.

The multiplexing can be arranged as random-access multiplexing or time-division multiplexing. Random-access multiplexing requires that each module have a unique address whereby the module can be called up, from above, without reference to the other modules. Time-division multiplexing requires that each module be addressed in sequence, i.e in pre-arranged order, respective time-slots for data-transmission being ascribed to each module. Since less up-hole and down-hole communication is needed, time-division multiplexing can draw somewhat less power from the battery, and is preferred for that reason. The surface control-unit is designed to communicate with all the modules, every time a gathering of data is performed, whereby there would be no advantage in providing the ability to random-access the modules. The length of the time-slot assigned to each module need not be the same on each occasion, but can be made dependent on how much data the particular module has to transmit. The shorter the total aggregate time taken for a scan of the modules, in gathering the data, the smaller the drain on the battery.

During standby, i.e when no data is being gathered, the microprocessors 124 in the modules, and in the surface control-unit, are switched off. However, the surface control-unit maintains its 9-volt (or other) battery connected across the two wires. Each module includes a capacitor 125. The capacitors are all kept charged, during the standby mode. When all are charged up to the full 9 volts, the current in the two wires drops basically to zero. In a real system, a tiny trickle of current will be needed to keep the capacitors charged up, but this is small enough to be regarded as comprising a zero drain on the battery.

If even the tiny trickle of current cannot be allowed, the power may be shut off altogether during standby. Then, when a data-gathering session is scheduled, the voltage can be applied to the two wires, and the capacitors in the modules brought up to full charge. Only when all the capacitors are fully charged (and that might take several seconds) would the start-of-scan procedure be initiated. The high resistance of the long wires does not affect the voltage to which the capacitors are charged, although the more resistance there is in the wires, the longer it will take for all the capacitors to reach full charge. Thus, even when the borehole is very deep (and therefore the wires are long, and their resistance is large), all the capacitors still reach full charge, eventually.

Thus, during standby (or at least, during the period immediately preceding a round of data gathering), each module has a fully charged capacitor. The function of the capacitor is to provide the module with enough energy to power the module's microprocessor 124, to at least enable the module to listen-in to the communications taking place on the two wires, and preferably enable the sensor 123 to take a reading.

When the two wires offer a high resistance (e.g due to long length), there might not be enough energy derivable from the surface-applied voltage across the wires, to power the microprocessors in the modules. Also, it will be understood that, during a data-gathering session, there are periods when there is no active voltage being applied between the two wires, from the surface (for example, there is no active voltage from the surface, that could be accessed from the wires by the modules, when the surface control-unit is sending instructions down to the modules (which it does preferably by configuring the data bits as voltage/short/voltage/short pulse sequences across the two wires)). The purpose of the capacitor is to keep the microprocessor circuits in the module energised through these times. In most cases, the capacitor can also be used to supply the energy needed to have the sensor in the module carry out a data measurement. The presence of the capacitors in the modules means that the measurement-taking operations can be launched and under way in the individual modules, even though the power needed to do that might not be available via the two wires. When the time comes for that module to transmit data, the system does not have to wait for the data measurement to be initiated.

On the other hand, during the actual act of transmitting data from the module to the surface, the module then can indeed be powered from the surface. The capacitor does not have to supply the power needed to transmit the actual data pulses from the module over the (perhaps quite high) resistance of the two wires. The power needed to drive the module to transmit the pulses can be taken from the two wires—because, when the module is transmitting data, the control unit places voltage across the wires. The data transmissions consist of modulated changes in the resistance of the module, and these take place while there is voltage on the line. The module can steal power from the applied voltage, at this time. Therefore, the capacitor is not required to supply the energy for the (sometimes quite high-energy) task of actually transmitting the data up the two wires.

The surface control-unit includes a means 28 for storing the data received from the modules, and for viewing and saving the data, and exporting it to other programs. It can be convenient to store the data in Flash-type memory in the surface unit.

The different types of sensors have different ways in which the data from the sensor has to be processed. The program particular to that sensor, with instructions on how to gather, interpret, and store the data from the module, is held in memory in the module. Also, the instructions on how to calibrate the sensor, the configuration constants, etc, are held in memory in the module. This information is presented to the surface control-unit, and may be passed on, as required, to the computer (not shown) that will eventually handle the data, but the information is stored on the module itself, and released along with the data from the module. It will be noted that this manner of presenting the data from the modules is in keeping generally with the "everything-on-the-module" modularity of the system as described herein.

Figure 14:
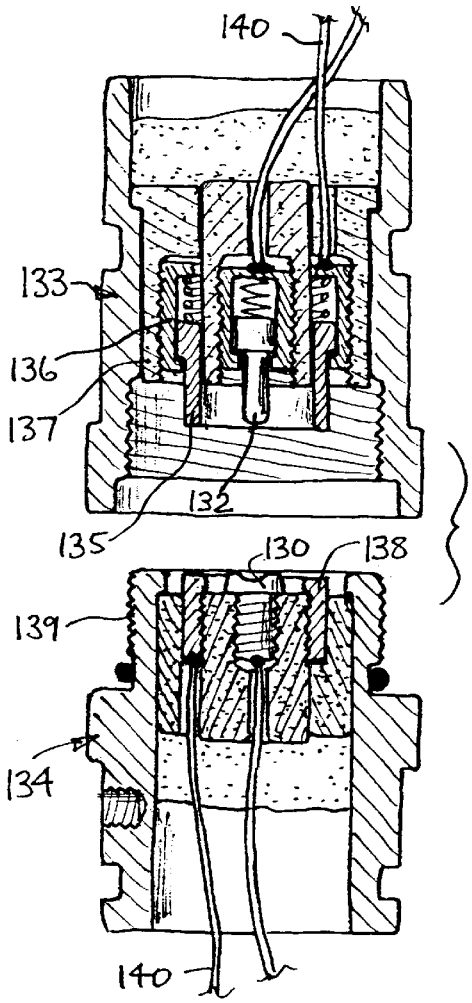
FIG. 14 is a cross-section of another type of connection between modules.

As shown in FIG. 14, the modules can be so arranged that the two wires of a two-wire data transmission system are both insulated from the casing of the modules.

The button 130 and plunger 132 are mounted in the plugs 133,134 as shown in FIG. 14. A second plunger is in the form of a ring 135, which can slide up/down relative to shank 136, which is fixed into a second insulative sleeve 137. A complementary ring 138 is fixed in the plug 134.

When the plugs 133,134 are screwed together, the plunger 132 makes contact with the button 130, and the plunger ring 135 makes contact with the fixed ring 138. The rings are co-axial with the plunger and with the screw thread 139.

Electrical leads 140 connect the contacts with the circuit boards carried on the modules.

It can be useful to insulate the housings of the modules from the two wires, as in FIG. 14, for some types of measurements. For example, some accuracy of depth definition can be lacking when one of the electrodes comprises the whole housing of the module; and some types of measurement can require that the two electrodes each be approximately the same size, which is not possible again when one of the electrodes comprises the whole housing of the module.

Alternatively, the arrangement as shown in FIG. 14 can be used to implement a three-wire data-transmission system, if the housing is also used to connect to a third wire. In that case, for example, the central electrode may be reserved for a power supply, and the ring electrode may be reserved for data communication, with the housing serving as ground.

An extension of the same principles as shown in FIG. 14 might theoretically be used by the designer, to add yet more conductors, all arranged co-axially, whereby all the conductors make contact as the modules are simply screwed together. However, in a down-borehole context, it will be understood that providing even just one ring surrounding the central plunger, as in FIG. 14, adds a good deal of complexity, and inevitably adds diameter to the module. Adding another ring (for a total of four conductors) adds even more complexity and diameter. It should be regarded that four conductors (i.e 1 central plunger; 2 first ring; 3 a second ring; 4 the housing) is the limit of complexity that could, in practice, be contemplated.

Figure 15:
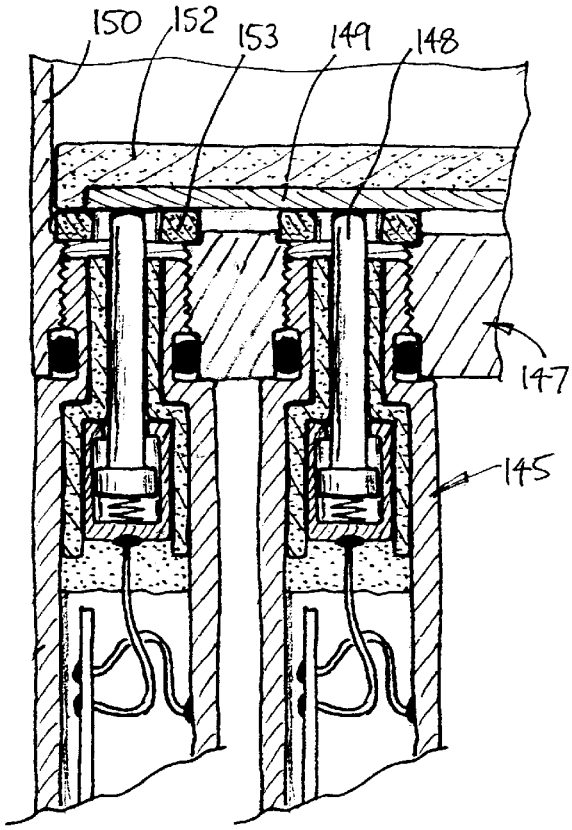
FIG. 15 is a section showing modules connected side by side to a base unit.

As shown in FIG. 15, the screw-together co-axial electrode system, though highly suitable, as explained, for a two-wire in-line or end-to-end arrangement of modules, can also be used for modules that screw into a base unit in a side-by-side configuration. This can be useful for taking measurements in a tank, for example, where diameter is not at such a premium as in a deep borehole, and where it might be more important to have the different sensors all at the same depth.

Each module 145 can be screwed into any one of the sockets in a base-unit 147. (Any of the sockets that do not contain modules would be fitted with a plug.) For each module 145, the sprung plunger 148 makes contact with a metal disc 149 in the base unit 147. The disc 149 is connected to one of the two wires going to the surface, and the housing 150 of the base-unit 147 is connected to the other of the two wires.

The disc 149 is insulated from the housing 150 by means of a plastic cup 152, and by plastic insulating rings 153.

The manner in which the surface unit interacts with the modules may be described and summarised alternatively as follows.

Although it is not ruled out that some modules might have a battery on board the module, generally the data transmission system as described herein if modules that do not have an on-board battery. The modules depend, for the energy needed to take and process a reading from the sensor and to transmit that data up the conductors to the surface unit, comes from the capacitor located on the module.

The processor on the module, which is powered by energy from the capacitor on the module, can apply, for data transmission purposes, only two basic conditions to the conductors, namely a short-circuit condition, and an open-circuit condition. The capacitor in the module does not store enough energy to transmit actual pulses of energy to the surface unit. That is to say, data transmission from the module is not done by transmitting pulses of energy up the conductors to the surface, but rather, data transmission from the module is done by subjecting the conductors to short/open/short/open pulses. In the surface unit, to read these pulses, a reference resistor is placed in-circuit, and the changes in the voltage drop across the reference resistor, at the surface, are sufficient to enable reliable detection of the difference between the short and the open condition of the module, down the borehole, perhaps many hundreds of meters below.

The energy for powering the module to switch between the open and short conditions comes from the energy stored in the capacitor in the module. The energy to power the means for detecting whether the module is subjecting the conductors to the open condition or to the short condition comes from the battery in the surface unit.

As mentioned, the down-hole module is capable of applying only two states to the conductors, i.e the short condition and the open condition. The surface unit, on the other hand, with its power supply, can apply four conditions to the conductors, namely: a) an open-circuit condition, b) a short-circuit condition, c) a full live-voltage condition, and d) and the live-voltage data-reading condition in which the reference resistor is inserted into one of the conductors.

The surface unit can set itself into a module charge-up mode, in which full live-voltage from the battery (or other power supply) in the surface unit is applied to the conductors. In this mode, the modules receive and extract the power from the conductors, and the capacitors in the modules are charged up.

If measurements are being taken continually, the surface unit may be programmed to maintain the charge-up mode all the time, apart from the times when actual data transmissions from the modules are required; or, if measurements are required only occasionally, the surface unit may be programmed to switch off altogether during the long non-measurement periods, and to just enter the charge-up mode for an appropriate period of time, prior to a series of measurements being taken.

To start a data-gathering session, all the capacitors in the modules being charged up, the surface unit applies a get-ready signal to the conductors. The get-ready signal comprises a short-circuit applied to the conductors by the surface unit, where the short-circuit lasts for a long period, e.g about five milliseconds. (Five milliseconds is far longer a period of continuous short-condition than could ever arise during transmission of the short/open/short/open pulses of the data-transmission mode.)

Each module has a short-circuit detector whereby, whenever a short circuit appears on the conductors, the module starts a timer. If the short circuit ends before about two milliseconds, nothing happens in the module. But if the short circuit condition lasts for more than two ms, the processor in the module turns on. The energy required to power the timer in the module, and to switch the processor on if the short circuit exceeds two milliseconds, is derived from that stored in the capacitor in the module—but the energy required to do this is minuscule.

Following the get-ready signal, i.e the long-lasting short-circuit, the processors in all the modules are now switched on, and powered by the energy stored in the capacitors in the modules. The processors now monitor the status of the conductors, and are receptive to signals transmitted from the surface unit.

The signals from the surface unit at this time take the form of pulses of live-voltage, alternating with short-circuiting of the conductors, applied by the surface unit. The information being put out by the surface unit at this time comprises the unique address of one of the modules. Each of the modules monitors the conductors for a period of about eight milliseconds, awaiting its address.

(For the transmission of information from the surface unit, it is preferred that the pulses comprise periods of voltage alternating with periods of short-circuit; the difference between voltage and short, rather than between voltage and open circuit, is preferred because the difference between voltage and short is more reliably detectable at the end of the long conductors, many metres down the borehole.)

If its address does not appear within eight milliseconds, the processor in the module turns itself off. In this off-condition, the module will respond to live voltage on the conductors, in that the capacitor in the module will then become charged, and the timer in the module will respond to any short-circuits that may appear on the conductors, and will measure the length thereof. The processor in the module will not turn itself on until the module once again receives the get-ready signal, being the long (more than two, e.g five, millisecond) short-circuit signal from the surface unit.

After sending out the address, the surface unit then enters the listening-for-data-from-the-modules mode. In this mode, the surface unit applies live-voltage to the conductors, but the reference voltage is included in-circuit. In this mode, the surface unit monitors the voltage drop across the reference resistor, whereby the surface unit can detect whether a short/open/short/open series of pulses is being applied to the conductors from below.

If one of the modules receives its unique address, that module now enters data-gathering mode. The processor in the module remains switched on, and sets the sensor in the module to take a measurement. The data-reader in the module reads the sensor, and represents the reading in digital form.

The processor in the module then transmits the digital data onto the conductors, which it does, as mentioned, by pulsing the conductors with the series of short/open/short/open pulses. This series is detected by the surface unit, whereby the data from the sensor in the module is received by the surface unit.

In some cases, it might take quite a while to take and process a reading from the sensor; so much so that the designer might fear that the capacitor in the module might run short of stored energy.

In respect of some of the modules, the surface unit can be programmed such that, when that particular module is active, a timer in the surface unit will supply full live-voltage to the conductors for a predetermined period of time. During this timed period, full power is present on the conductors, and the module can draw energy from the conductors for the acts of reading the sensor, processing the data, and of course keeping the capacitor charged. (The capacitors in the other modules will incidentally be recharged in this period too.

During this predetermined period, when the surface unit is supplying full voltage to the modules, it is not practical to transmit data pulses on the conductors. That is why the end of the power-supplied period should preferably be predetermined simply by a timer in the surface unit, and not by signals transmitted via the conductors.

Once the timer in the surface unit ends the power-supplied period, the module is now ready to transmit the data from the sensor reading, and the surface unit now goes back to applying voltage across the reference resistor, at the surface, whereby now the surface unit can receive and detect the short/open/short/open data pulses being put onto the conductors by the module.

For those modules where the reading can be taken quickly, the capacitor on the module can supply all the sensor's energy requirements, and there is no need to bother with a timed period of feeding power down to the module from the surface unit.

Once the data transmission from that module has been completed, now the surface unit proceeds to issue another get-ready signal (i.e the five-millisecond short-circuit) onto the conductors. The modules again all receive the get-ready signal, whereupon the modules all once again switch their processors on, whereby the modules can monitor the conductors, listening for their own unique addresses.

The above describes normal operation of the surface unit and the modules, for taking readings from the sensors. The surface unit can be programmed also for special procedures, such as setting-up, calibration, address-allocation, testing, etc. These activities may be carried out with the modules fixed into the base-unit, at the end of the conductors, prior to lowering same down the borehole, or with the modules separated from the base unit.

Another way will now be described, in which the system may be operated in a special manner.

As mentioned, the designer may prefer that some of the modules, or indeed all of the modules, be given a boost of voltage, to enable the capacitor in the module to remain fully charged, while the readings of the sensor are being taken, and while the data is being processed internally within the module.

The modules generally have different requirements as to the length of the period of time during which this boost of voltage should be applied. The period of application of the full voltage has to be controlled by a timer at the surface: controlling the period by signalling the state of charge from the module is not practical, i.e it is not practical for the surface unit to read signals from the modules, at the same time as the surface unit is applying full live voltage to the conductors. The module can be programmed to respond to accept the cessation of full voltage as the signal for the module to start data transmission.

The designer assesses, in respect of each module, how much time that module needs, to enable the module to take a reading from its sensor, and to process that reading into digital form, ready to transmit to the surface. The length of time the voltage boost is to remain on the conductors is computed accordingly. The designer arranges for the module to feed its boost period to the surface unit at the time the surface unit allocates the module's unique address.

The surface unit stores the boost period length in memory, under that module's unique address.

To put this into effect, the surface unit stores the special requirements (if any) of each module at the time the surface unit was allocating the unique address for that module. In other words, the special manner of operation of the particular module is stored in memory, under that module's address, in the surface unit, to be carried out whenever the surface unit addresses that module.

The system may be set up so that the surface unit always cycles through all the addresses it has stored in memory. If one of the modules for which the surface unit has an address is not present, the surface unit simply waits a few milliseconds for that module to answer, and if no answer comes, the surface unit proceeds with the next module address. This mode of operation enables the user to select just a few (or just one) from a large stable of pre-addressed modules, for placement in the borehole, and no adjustments or other arrangements whatever need be made, besides screwing in the selected module(s).

It is contemplated that there may be more than one set of modules in the borehole; for example, the bottom-most module of a set of modules may be arranged with a means for attaching conductors underneath that module, and those conductors lead down to another set of conductors installed at a deeper level below.

What is claimed is:

1. Apparatus for measuring and recording data from a borehole, wherein:

the apparatus includes a surface unit and a down-hole unit;

the apparatus includes a unit-connecting-means, which includes a mechanical suspension means for supporting the down-hole unit from the surface unit;

the down-hole unit includes a base unit, which remains fixed to a bottom end of the suspension means;

the down-hole unit includes a plurality of modules, which house respective sensors;

the unit-connecting-means includes two long, relatively-insulated, metal conductors, running from the surface unit;

the base unit includes two relatively-insulated metal conductors, which correspond to, and remain in metal-to-metal electrical contact with, the two conductors in the unit-connecting-means;

each module includes two relatively-insulated metal conductors, corresponding to the two conductors in the base-unit;

the structure of the base unit, and of each module, is such that the two conductors in the module make metal-to-metal electrical contact with the corresponding two conductors in the base unit, the apparatus includes a data transmission system, for transmitting data via the conductors between the surface unit and the modules;

the modules include:

each an operable data-reader, which is effective, when operated, to take a reading of the respective sensor;

each a digitiser, representing that reading digitally, as a series of electrical pulses; and each an operable data-transmitter, which is effective, when operated, to apply that series of electrical pulses to the conductors in the module;

the data transmission system includes a multiplexer, for allocating respective transmission periods of time to the modules, each transmission period being a period during which the module can apply its own series of pulses to the conductors; and the modules include each a line-monitor, for recognizing that module's allocated transmission period, and for operating the data-transmitter of that module, and thereby for applying that module's series of pulses between the two conductors, during that period.

2. Apparatus of claim 1, wherein each module is mechanically self-contained, and the down-hole unit is so structured that each module can be mechanically assembled, directly or indirectly, into, and disassembled from, the base unit.

3. Apparatus of claim 2, wherein each module is electrically self-contained, in that the module, when assembled to the base unit, is electrically operational independently of the assembly or disassembly of others of the modules.

4. (a1) Apparatus of claim 3, the modules being so structured that they can be assembled directly to the base unit, wherein:

the base unit includes a plurality of connection-sockets, arranged side-by-side, and the modules include respective complementary connection-plugs;

whereby the modules can be plugged directly to the base unit, in side-by-side parallel configuration.

5. (a1) Apparatus of claim 3, the modules being so structured that they can be assembled indirectly to the base unit, wherein:

the base unit includes one connection-socket, and each module includes one corresponding connection-socket, and each module includes one complementary connection-plug;

whereby a first one of the modules is so structured that it can be assembled directly to the base unit, a second one of the modules is so structured that it can be assembled directly to the first one of the modules, and a third module directly to the second, and so on; and whereby the modules can be assembled to the base unit, and to each other, in end-to-end series configuration.

6. (a1) Apparatus of claim 1, wherein:

the base-unit includes a screw-thread connection, and each of the modules includes a respective complementary screw-thread connection;

one of the two conductors comprises a button and plunger connection between the base-unit and the module;

the button and plunger connection lies on the axis of the screw-thread connection; and the button and plunger connection is urged into electrical contact upon the module being screwed to the base unit.

7. (a1) Apparatus of claim 6, wherein:

the apparatus includes a third conductor, additional to the said two conductors, which includes a ring and plunger-ring connection;

the ring and plunger-ring connection lies on the axis of the screw-thread connection;

the ring and plunger-ring connection is urged into electrical contact upon the module being screwed to the base unit.

8. (a1) Apparatus of claim 6, wherein the other of the two conductors comprises housings of the base-unit and of the modules.

9. (a1) Apparatus as in claim 1, wherein:

the operable data-transmitter on the module is effective, when operated, to apply the pulses in the form of a sequence of open-circuit and short-circuit conditions between the conductors;

the data transmission system is operable in a data-communication-from-the-modules mode;

the surface unit includes a means for applying a voltage between the conductors, at the surface, during the data-communication-from-the-modules mode;

and the surface unit includes a reader, for reading the pulses at the surface by detecting the difference at the surface between the open-circuit and short-circuit conditions.

10. (a1) Apparatus as in claim 1, wherein:

the apparatus is operable in a data-communication-from-above-ground mode;

the surface unit is so structured as to apply pulses in the form of a sequence of voltage and no-voltage conditions between the conductors, at the surface, during the data-communication-from-above-ground mode;

and the said modules include respective readers, for reading the pulses by detecting the difference, at the module, between the voltage-condition and the no-voltage-condition.

11. Apparatus of claim 10, wherein the surface unit is so structured that, when applying the voltage-condition between the conductors, the surface unit is effective to place a reference resistor in-circuit, in the surface unit, and to apply live voltage between the conductors, across the reference resistor.

12. Apparatus of claim 11, wherein the surface unit is so structured that, when applying the no-voltage-condition between the conductors, the surface unit is effective to short-circuit the conductors together in the surface unit.

13. Apparatus of claim 1, wherein the surface unit is operable in a quick-charge mode, in which the surface unit is effective to apply live voltage between the conductors substantially without resistance in the conductors in the surface unit.

14. (a1) Apparatus as in claim 1, wherein:

the data-transmission system is operable in a standby mode;

the surface unit includes a means for applying a voltage between the conductors, at the surface, during the standby mode;

in respect of the modules:

the module includes a respective capacitor, which is so connected and arranged in the module a s to be charged to the voltage applied between the conductors, during the standby mode; and the module includes a means for applying energy stored in the capacitor to operate the respective line-monitor.

15. (a1) Apparatus as in claim 14, wherein;

the surface unit includes an operable means for placing a get-ready signal between the conductors, in standby mode;

in respect of each of the modules the line-monitor thereof is effective to read the get-ready signal, and to place the module in a condition to receive data communication from the surface unit;

and the capacitor thereof is large enough to store enough energy to power the respective line-monitor to do so.

16. (a1) Apparatus of claim 15, wherein the capacitor is large enough to store enough energy also to operate the data-reader of the module.

17. (a1) Apparatus of claim 15, wherein;

the get-ready signal comprises a short-circuit applied between the conductors in the surface unit continuously for at least a time T1;

and each module includes a timer, which is effective to determine the length of the time T1 during which the conductors are shorted, and is programmed to be effective, in response to the time T1 being greater than two milliseconds, to switch the processor in the module on;

and the structure of the module is such that the timer of that module is powered by the capacitor of that module.

18. (a1) Apparatus of claim 15, wherein;

the surface unit is effective to assign to the modules each a respective unique address, and to store the respective addresses in memory on the modules, and all the addresses in memory on the surface unit;

the multiplexer in the surface unit is so programmed as to be operable upon completion of the get-ready signal; and the multiplexer is so programmed as to be effective, when operated, to transmit one of the addresses as a pulsing series of voltage and no-voltage conditions between the conductors.

19. (a1) Apparatus of claim 18, wherein:

the modules are so structured that any module which does not receive its unique address within a period of time T2 reverts to a snitched-off condition;

the switched-off condition of the module is a condition in which the timer remains capable of determining the length of the time T1 of a short-circuit pulse on the conductors, and in which the capacitor in the module remains capable of being charged by the application of live voltage to the conductors from the surface unit.

20. (a1) Apparatus of claim 18, wherein:

the modules are so structured that, upon receiving its unique address, the module enters a switched-on condition;

the switched-on condition of the module is a condition in which the processor on the module it operational, and is effective to operate the data-reader, and then to operate the data-transmitter, and then to cause the module to revert to the switched-off condition.

21. (a1) Apparatus of claim 20, wherein:

in respect of one of the modules, when that module has been addressed, the surface unit is effective to supply live voltage to the conductors, at the surface, for a charge-boost period of time T3;

whereby, during the charge-boost period T3, the module receives power from the conductors;

and the processor in the module is programmed to operate the data-transmitter only after the charge-boost period T3 has elapsed.

22. Apparatus of claim 21, wherein the surface unit includes a timer, and the length T3 of the charge-boost period is determined by a setting of the timer in the surface unit.

23. Apparatus of claim 18, wherein memory of the unique addresses is stored in the surface unit and in the modules in a non-volatile form.

24. Apparatus for measuring and recording data from a borehole, wherein:

the apparatus includes a surface unit and a down-hole unit;

the apparatus includes a mechanical suspension, for supporting the down-hole unit from the surface unit;

the down-hole unit includes a plurality of modules, which house respective sensors;

the apparatus includes a data transmission system, which includes a module-controller and a data-logger;

the module-controller and data-logger include two relatively-insulated metal conductors;

each module of the plurality of modules includes two relatively-insulated metal conductors, corresponding to the two conductors in the module-controller and data-logger;

the module-controller is arranged for transmitting control signals from the module-controller to the modules, via the conductors;

the data-logger is arranged for receiving data signals into the data-logger, from the modules, via the conductors;

the structure of the module-controller and data-logger, and each module, is such that the two conductors in the module make metal-to-metal electrical contact with the corresponding two conductors in the module-controller and data-logger;

the data transmission system is arranged for transmitting control signals from the module-controller to the modules, via the conductors, and for receiving data signals from the modules into the data-logger, via the conductors;

the modules include:

each an operable data-reader, which is effective, when operated, to take a reading of the respective sensor;

each a digitiser, for representing that reading digitally, as a series of electrical pulses; and each an operable data-transmitter, which is effective, when operated, to apply that series of electrical pulses to the conductors in the module;

the data transmission system includes a multiplexer, for allocating respective transmission periods of time to the modules, each transmission period being a period during which the module can apply its own series of pulses to the conductors; and the modules include each a line-monitor, for recognizing that module's allocated transmission period, and for operating the data-transmitter of that module, and thereby for applying that module's series of pulses between the two conductors, during that period.

* * * * *